US010865757B2

(12) United States Patent
Nakaoka et al.

(10) Patent No.: US 10,865,757 B2
(45) Date of Patent: Dec. 15, 2020

(54) ENGINE STARTING SYSTEM AND STARTER

(71) Applicant: DENSO CORPORATION, Kariya (JP)

(72) Inventors: Takuro Nakaoka, Kariya (JP); Akihiro Imura, Kariya (JP); Mitsuru Shibanuma, Kariya (JP); Yuki Kubo, Kariya (JP); Minoru Okamiya, Kariya (JP); Suguru Mizuno, Kariya (JP)

(73) Assignee: DENSO CORPORATION, Kariya (JP)

( * ) Notice: Subject to any disclaimer, the term of this patent is extended or adjusted under 35 U.S.C. 154(b) by 185 days.

(21) Appl. No.: 16/308,699

(22) PCT Filed: Jun. 15, 2017

(86) PCT No.: PCT/JP2017/022171
§ 371 (c)(1),
(2) Date: Dec. 10, 2018

(87) PCT Pub. No.: WO2017/217501
PCT Pub. Date: Dec. 21, 2017

(65) Prior Publication Data

US 2019/0145368 A1 May 16, 2019

(30) Foreign Application Priority Data

Jun. 16, 2016 (JP) ..... 2016-119994
May 25, 2017 (JP) ..... 2017-103946

(51) Int. Cl.
*F02N 11/00* (2006.01)
*F02N 11/08* (2006.01)
(Continued)

(52) U.S. Cl.
CPC ..... *F02N 11/006* (2013.01); *F02N 11/04* (2013.01); *F02N 11/0851* (2013.01);
(Continued)

(58) Field of Classification Search
CPC .. F02N 11/006; F02N 11/0851; F02N 15/022; F02N 11/04; F02N 15/04;
(Continued)

(56) References Cited

U.S. PATENT DOCUMENTS

2009/0224557 A1* 9/2009 Reynolds ..... F02N 15/023 290/38 R
2011/0056450 A1* 3/2011 Notani ..... F02N 11/0855 123/179.4
(Continued)

FOREIGN PATENT DOCUMENTS

JP 2004-346770 A 12/2004
JP 2007-246030 A 9/2007
JP 5875664 B1 3/2016

OTHER PUBLICATIONS

Jul. 11, 2017 International Search Report issued in Patent Application No. PCT/JP2017/022171.

*Primary Examiner* — Joseph J Dallo
*Assistant Examiner* — Scott A Reinbold
(74) *Attorney, Agent, or Firm* — Oliff PLC

(57) ABSTRACT

A first controller includes a start control section and a passage determination section. After activating a second starter to start cranking, the start control section stops the operation of the second starter and starts the motor operation of the first starter at a predetermined timing. The passage determination section determines whether a predetermined passage conditional expression holds after cranking is started by the second starter. The start control section stops the operation of the second starter and starts the motor operation of the first starter if the passage conditional expression holds before the engine passes the first compression top dead center, regardless of whether the engine has passed the first compression top dead center.

20 Claims, 12 Drawing Sheets

(51) Int. Cl.
*F02N 15/02* (2006.01)
*F02N 11/04* (2006.01)
*F02N 15/04* (2006.01)

(52) U.S. Cl.
CPC ..... *F02N 15/022* (2013.01); *F02N 15/04* (2013.01); *F02N 2300/104* (2013.01)

(58) Field of Classification Search
CPC .... F02N 2300/104; F02N 11/00; F02N 11/08; F02N 11/0818; F02N 11/0825; F02N 11/0829; F02N 11/0833; F02N 11/0837; F02N 11/0844; F02N 11/084; F02N 2200/00; F02N 2200/023; F02N 2200/02; F02N 2300/00; F02N 2300/20; F02N 2300/304
USPC ..... 123/179.3
See application file for complete search history.

(56) References Cited

U.S. PATENT DOCUMENTS

2016/0065107 A1* 3/2016 Klein ..... F02N 11/08 290/31
2018/0058410 A1* 3/2018 Fujita ..... F02D 41/062
2019/0390640 A1* 12/2019 Ishida ..... F02N 11/0851

* cited by examiner

ENGINE STARTING SYSTEM AND STARTER

CROSS-REFERENCE TO RELATED APPLICATION

This application is based on and claims the benefit of priority from earlier Japanese Patent Application No. 2016-119994 filed on Jun. 16, 2016 and No. 2017-103946 filed on May 25, 2017, the description of which is incorporated herein by reference.

TECHNICAL FIELD

The present disclosure relates to a technique for starting an engine using first and second starters.

BACKGROUND ART

For example, a known technique for starting an engine uses a motor generator that functions as an electric generator and a motor in combination with a pinion enmeshing starter (see PTL 1).

According to this technique, after the starter is activated to start cranking the engine, the starter is stopped and the motor operation of the motor generator is started with the following timing. The timing of stopping the starter is set to be after fuel injection is started and after the first compression top dead center (TDC) is passed. The timing of starting the motor operation of the motor generator is set to be after the first TDC is passed and before the next TDC is reached.

CITATION LIST

Patent Literature

[PTL 1] JP 5875664 B

SUMMARY OF THE INVENTION

Technical Problem

With the technique described above, the timing of stopping the starter is set to be after fuel injection is started and after the first TDC is passed. However, the fuel injection will not start unless the cylinder discrimination by a crank angle sensor of the engine has completed. That is, the engine needs to be cranked several times before fuel injection is started. In this case, a one-way clutch is reengaged before the starter is stopped. Therefore, it is not always possible to reduce the engine starting sound generated during cranking. When the one-way clutch is reengaged, the driving side/driven side is switched between a ring gear and a pinion. The generation of the engine starting sound during cranking results from this switching between the driving side/driven side. More specifically, the engine starting sound is generated by the ring gear and pinion colliding with each other due to the switching between the driving side/driven side and meshing with each other.

In the technique described above, the operation of the starter is stopped after fuel injection is started and the first TDC is passed. This configuration makes it difficult to be shortened the driving time of the starter, thus increasing the time during which the sound is generated by the ring gear and pinion meshing with each other.

The present disclosure provides an engine starting system that minimizes the engine starting sound generated during cranking.

Solution to Problem

In one aspect of the technique of the present disclosure, an engine starting system includes a first starter, a second starter, and a controller. The first starter is connected to a crankshaft of the engine and rotates the crankshaft. The second starter cranks the engine by rotatably driving a ring gear connected to the crankshaft. The controller controls the operation of the first and second starters.

The first starter is a motor generator having a function of an electric generator and a function of an electric motor. The second starter is a pinion enmeshing starter. The second starter includes a motor, a pinion, a one-way clutch, and a solenoid device. The motor receives electric power to cause it to rotate. The pinion moves axially to mesh with the ring gear. The one-way clutch transmits torque in only one direction from the motor to the pinion, and thus blocks torque transmission from the pinion to the motor. The solenoid device has a function of moving the pinion in the axial direction and a function of starting/stopping (turning on/off) power supply to the motor.

"Required passage torque" refers to the torque determined by adding the rotational torque obtained with the kinetic energy stored in the engine from the start of cranking and the drive torque that can be outputted with the motor operation of the first starter. "Engine starting torque" is the torque determined by adding the compression torque and the friction torque of the engine. In a passage conditional expression, a magnitude relationship is defined in which the required passage torque is greater than the engine starting torque (i.e., a magnitude relationship represented by the required passage torque>the engine starting torque). The controller includes a start control section and a passage determination section. After activating the second starter to start cranking in response to a request for starting the engine, the start control section stops the operation of the second starter and starts the motor operation of the first starter at a predetermined timing. The passage determination section determines whether the passage conditional expression holds after cranking is started by the second starter. The start control section stops the operation of the second starter and starts the motor operation of the first starter if the passage conditional expression holds before the engine passes the first compression top dead center regardless of whether the engine has passed the first compression top dead center.

If the passage conditional expression holds after cranking is started by the second starter and before the engine passes the first compression top dead center, the engine starting system of the present disclosure makes a determination as follows. The engine starting system determines that the engine can pass the first compression top dead center, even if the second starter is stopped, when the passage conditional expression holds. Therefore, when the passage conditional expression holds, the operation of the second starter can be stopped before the engine passes the first compression top dead center. This allows the engine starting system of the present disclosure to stop the operation of the second starter (i.e., pinion enmeshing starter) earlier than with the conventional technique. As a result, the driving time of the second starter can be shortened, minimizing the sound of the pinion and the ring gear meshing with each other.

DESCRIPTION OF THE EMBODIMENTS

Embodiments of the technique of the present disclosure will be described in detail with reference to the drawings.

First Embodiment

Figure 1:
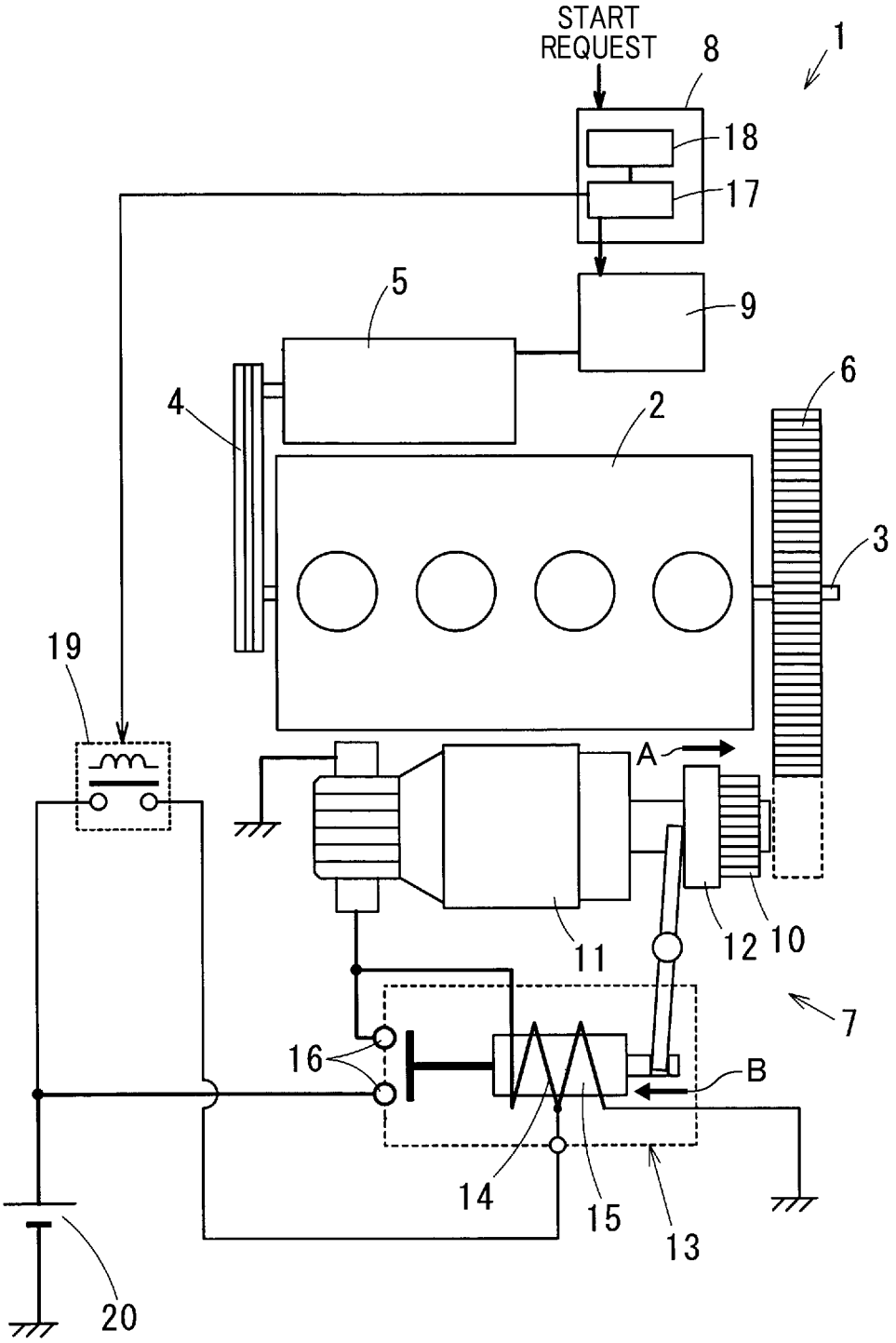
FIG. 1 illustrates the configuration of an engine starting system, according to a first embodiment.

As illustrated in FIG. 1, an engine starting system 1 of the present embodiment includes a first starter 5, a second starter 7, and a first controller 8. The first starter 5 is connected to a crankshaft 3 of an engine 2 via a belt 4. The second starter 7 is connectable to a ring gear 6 mounted on the crankshaft 3. The first controller 8 controls the operation of the first starter 5 and the second starter 7. The first controller 8 contains, for example, a microcomputer. The microcomputer includes a CPU that realizes a control function and an arithmetic function, a storage device (memory) such as a ROM and a RAM, and an input/output (I/O) device. The storage device includes a non-transitory tangible computer-readable storage medium. The first controller 8 receives a signal indicating a detection value (detection information) from various detectors for detecting the state of the engine 2. The first controller 8 outputs a signal (control information) for controlling the engine 2 based on the input signal.

The first starter 5 is a motor generator having a function of an electric generator and a function of an electric motor. The first starter 5 includes a second controller 9 separate from the first controller 8. The operation of the first starter 5 is controlled by the second controller 9. As with the first controller 8, the second controller 9 contains a microcomputer including a CPU, a ROM, a RAM, an I/O device, and the like. The second controller 9 receives a signal indicating a control command from the first controller 8. The second controller 9 also receives a signal indicating a detection value (detection information) from various detectors for detecting the state of the first starter 5 or the like. Based on these input signals, the second controller 9 outputs a signal (control information) for controlling the first starter 5. The second controller 9 includes an inverter circuit for adjusting a voltage and a frequency to be applied to the first starter 5. The microcomputer of the second controller 9 can control the rotational speed of the first starter 5 by outputting a signal to the inverter circuit.

The second starter 7 pushes out a pinion 10 in the axial direction A (the right direction in FIG. 1) so that it meshes with the ring gear 6. The second starter 7 transmits torque generated in a motor 11 to the pinion 10 to rotatably drive the ring gear 6. Thus, the second starter 7 is a known pinion enmeshing starter. The second starter 7 includes a clutch 12, an electromagnetic switch 13, and the like.

The clutch 12 is a one-way clutch that transmits torque in one direction only. The clutch 12 transmits torque generated in the motor 11 from the motor to the pinion, while it blocks torque transmission from the pinion to the motor.

The electromagnetic switch 13 includes a solenoid 14, a plunger 15, and the like. The solenoid 14 generates an electromagnetic force by energization. The plunger 15 is pulled in the direction B (the left direction in FIG. 1) by the electromagnetic force of the solenoid 14. The electromagnetic switch 13 moves the pinion 10 in the direction A (the right direction in FIG. 1) in conjunction with the movement of the plunger 15. Furthermore, the electromagnetic switch 13 opens/closes a main contact 16 provided on a power supply line of the motor 11 to start/stop (turn on/off) the power supply to the motor 11.

The first controller 8 has a function of a start control section 17 and a function of a passage determination section 18. The start control section 17 controls the operation of the first and second starters 5, 7 in starting the engine 2. After cranking of the engine 2 is started, the passage determination section 18 determines whether a passage conditional expression described later holds. The start control section 17 and the passage determination section 18 may be implemented by, for example, the CPU executing a program stored on a storage device (memory) of the microcomputer (that is, by software), as will be described later. The start control section 17 and the passage determination section 18 may be implemented with other methods. For example, the start control section 17 and the passage determination section 18 may be implemented by combining electronic circuits such as an IC (that is, by hardware).

Figure 2:
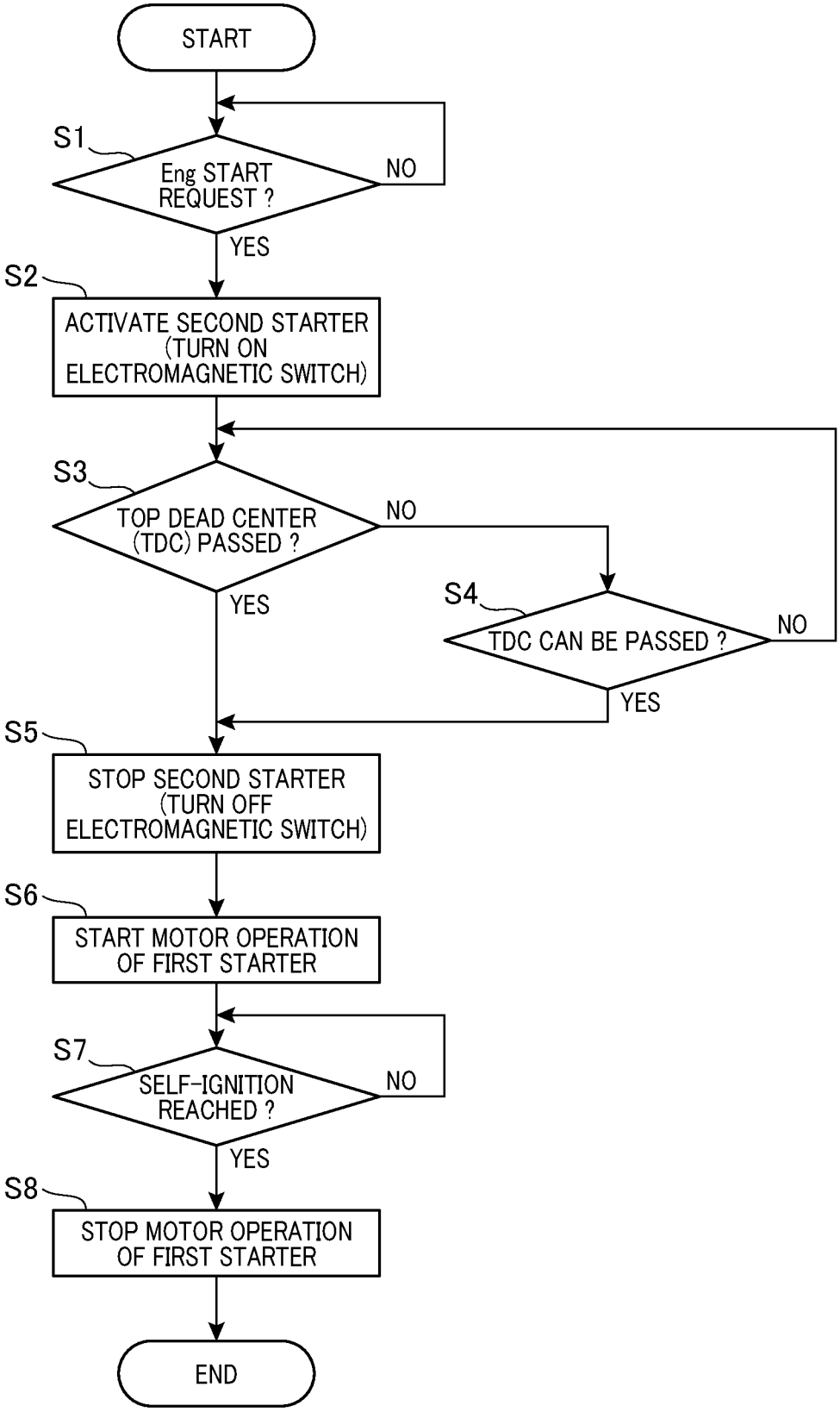
FIG. 2 is a flowchart illustrating a control procedure in starting an engine, according to the first embodiment.

A control procedure in starting an engine, executed by the first controller 8 of this embodiment, will be described with reference to a flowchart of FIG. 2. The steps S1 to S8 mentioned below correspond to the S1 to S8 designating the steps of the flowchart illustrated in FIG. 2.

At step S1, the first controller 8 determines whether a request to start the engine 2 has been inputted. For example, the start request for the engine 2 is outputted when the driver loosens the brakes after "idle-stop" is activated, or the shift lever is switched from the N range (neutral) to the D range (drive). The idle-stop is a known technique for automatically stopping the engine 2 when the vehicle is temporarily stopped at an intersection or the like. The first controller 8 repeats the process at step S1 until the start request for the engine 2 is inputted (NO at step S1). When the start request for the engine 2 is inputted (YES at step S1), the first controller 8 proceeds to the process at step S2.

The first controller 8 causes the start control section 17 to perform the following start control on the second starter 7. Specifically, at step S2, the start control section 17 starts the second starter 7 by outputting a turn-on signal (start signal) to a relay 19 (FIG. 1) provided in the energization line of the solenoid 14 and turning on the electromagnetic switch 13. With the relay 19 turned on, the solenoid 14 receives power from the battery 20 to generate an electromagnetic force in the electromagnetic switch 13. In the electromagnetic switch 13, the plunger 15 is pulled in by the electromagnetic force to move in the B direction (the left direction in FIG. 1). This operation of the electromagnetic switch 13 causes the pinion 10 to be pushed out in the direction A (the right direction in FIG. 1) to mesh with the ring gear 6. Then the main contact 16 is closed, so that electric power is supplied from the battery 20 to the motor 11. As a result, the torque of the motor 11 is transmitted to the pinion 10 via the clutch 12 to rotatably drive the ring gear 6.

At step S3, the first controller 8 determines whether the engine 2 has passed the first compression top dead center (first TDC). The determination of whether the engine 2 has passed the first TDC is made based on, for example, an engine speed measurable by an existing crank angle sensor (not shown), where the engine speed may be calculated based on a crank angle measured by the crank angle sensor. Alternatively, the determination may be made based on at least one of the rotational speed, the torque, and the current of the first starter 5 connected to the crankshaft 3. If the engine 2 has not passed the first TDC (NO at step S3), the first controller 8 proceeds to the process at step S4. If the engine 2 has passed the first TDC (YES at step S3), the first controller 8 proceeds to the process at step S5.

At step S4, the first controller 8 causes the passage determination section 18 to determine whether the passage conditional expression holds.

In the passage conditional expression, a predetermined condition is defined for determining whether the engine 2 can pass the first TDC when the operation of the second starter 7 is stopped before the engine 2 passes the first TDC. Specifically, the passage conditional expression is "required passage torque>engine starting torque". Therefore, the passage determination section 18 determines that the first TDC can be passed if this magnitude relationship holds (i.e., if the required passage torque is greater than the engine starting torque). The required passage torque is calculated by adding the rotational torque obtained with the kinetic energy stored in the engine 2 from the start of cranking and the drive torque that can be outputted with the motor operation of the first starter 5. The engine starting torque is calculated by adding the compression torque and the friction torque of the engine 2.

Figure 3A:
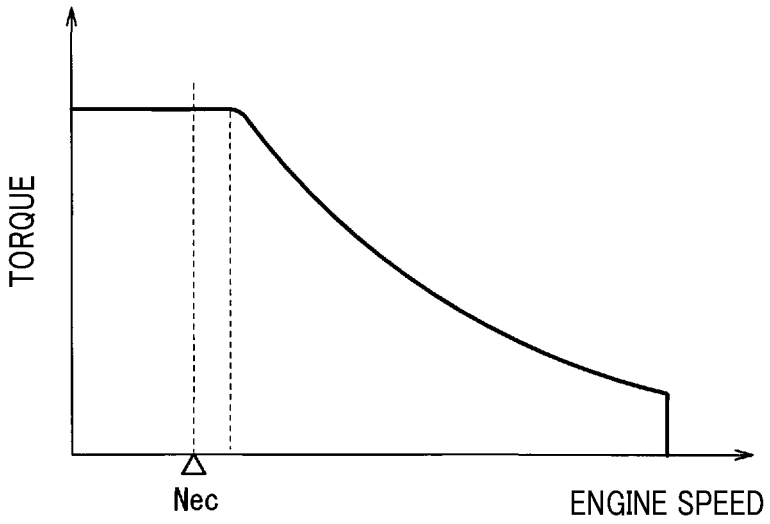
FIG. 3A illustrates an output limit map, according to the first embodiment.
Figure 3B:
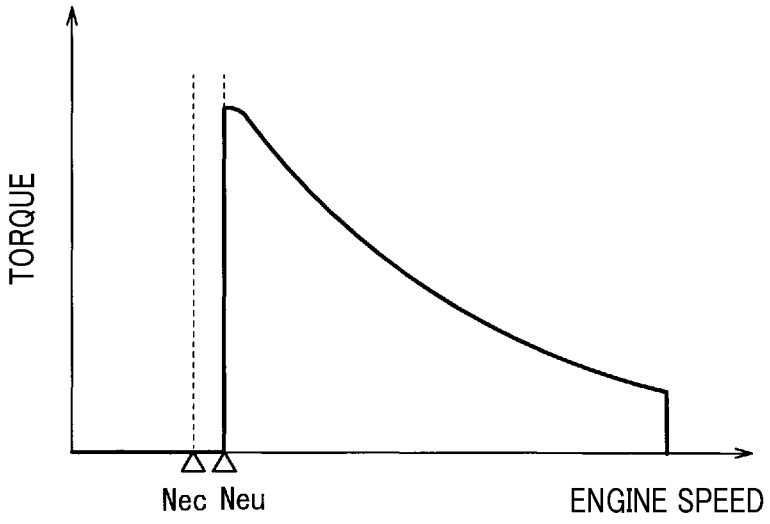
FIG. 3B illustrates an output limit map, according to the first embodiment.

In the present embodiment, known values are inputted to the passage determination section 18 as the compression torque and the friction torque of the engine 2. Then the passage determination section 18 calculates drive torque that can be outputted by the first starter 5 based on an output limit map (data map) of the second controller 9. FIGS. 3A and 3B illustrate an output limit map according to the present embodiment. As illustrated in FIGS. 3A and 3B, the output limit map is data indicating the correlation between the engine speed and driving torque that can be outputted by the first starter 5. The drive torque that can be outputted by the first starter 5 is calculated by applying the engine speed to the output limit map.

The value of rotational speed, Nec, illustrated in FIG. 3A, is a rotational speed that allows switching from cranking by the second starter 7 to cranking by the first starter 5.

Therefore, to prevent the passage conditional expression from being satisfied before the engine speed reaches Nec, the output limit map may be set as follows. As illustrated in FIG. 3B, in the output limit map, the numerical value of driving torque may be set to zero in a range where the engine speed is Neu or less which is slightly larger than Nec.

The rotational torque obtained with the kinetic energy stored in the engine 2 can be calculated from the moment of inertia of the rotating system including the crankshaft 3 and the ring gear 6 and from the engine speed. Therefore, by inputting a known value to the moment of inertia of the rotating system, the engine speed can be calculated that allows for passage.

Thus, the passage determination section 18 determines whether the passage conditional expression holds, based on the engine speed that allows for passage. That is, the passage conditional expression holds when the engine speed measurable by a crank angle sensor or the like exceeds the engine speed that allows for passage.

If the passage conditional expression holds (YES at step S4), the first controller 8 proceeds to the process at step S5. If the passage conditional expression does not hold (NO at step S4), the first controller 8 returns to the process at step S3.

The first controller 8 causes the start control section 17 to perform the following stop control on the second starter 7. Specifically, at step S5, the start control section 17 outputs a turn-off signal (stop signal) to the relay 19 to turn off the electromagnetic switch 13, thereby stopping the operation of the second starter 7. When the electromagnetic switch 13 is turned off, the pinion 10 is disengaged from the ring gear 6, and the main contact 16 is opened, so that the power supply from the battery 20 to the motor 11 is stopped in the second starter 7. In the execution of step S5, the relay 19 functions as a stop signal receiver that receives a stop signal for stopping the operation of the second starter 7.

The first controller 8 causes the start control section 17 to perform the following control on the first starter 5. Specifically, at step S6, the start control section 17 outputs a drive command (start signal) to the second controller 9 to start the motor operation of the first starter 5. The motor operation of the first starter 5 is started with the timing before the engine 2 passes the first TDC. For example, as illustrated in the timing diagram of FIG. 4, this timing is the same as that at which the operation of the second starter 7 is stopped. In the execution of step S6, the second controller 9 functions as a start signal receiver that receives a start signal for starting the motor operation of the first starter 5.

At step S7, the first controller 8 determines whether the engine 2 has reached self ignition. The first controller 8 determines that the engine 2 has reached self ignition if the engine speed exceeds a predetermined speed for self ignition. The process at step S7 is repeated until the engine 2 reaches self ignition (NO at step S7). If it is determined that the engine 2 has reached self ignition (YES at step S7), the first controller 8 proceeds to the process at step S8.

The first controller 8 causes the start control section 17 to perform the following control on the first starter 5. Specifically, at step S8, the start control section 17 outputs a stop command to the second controller 9 to stop the motor operation of the first starter 5. The first starter 5 is connected to the crankshaft 3 via a belt 4. Therefore, the first starter 5 functions as an electric generator after the motor operation is stopped.

Advantageous Effects

Figure 4:
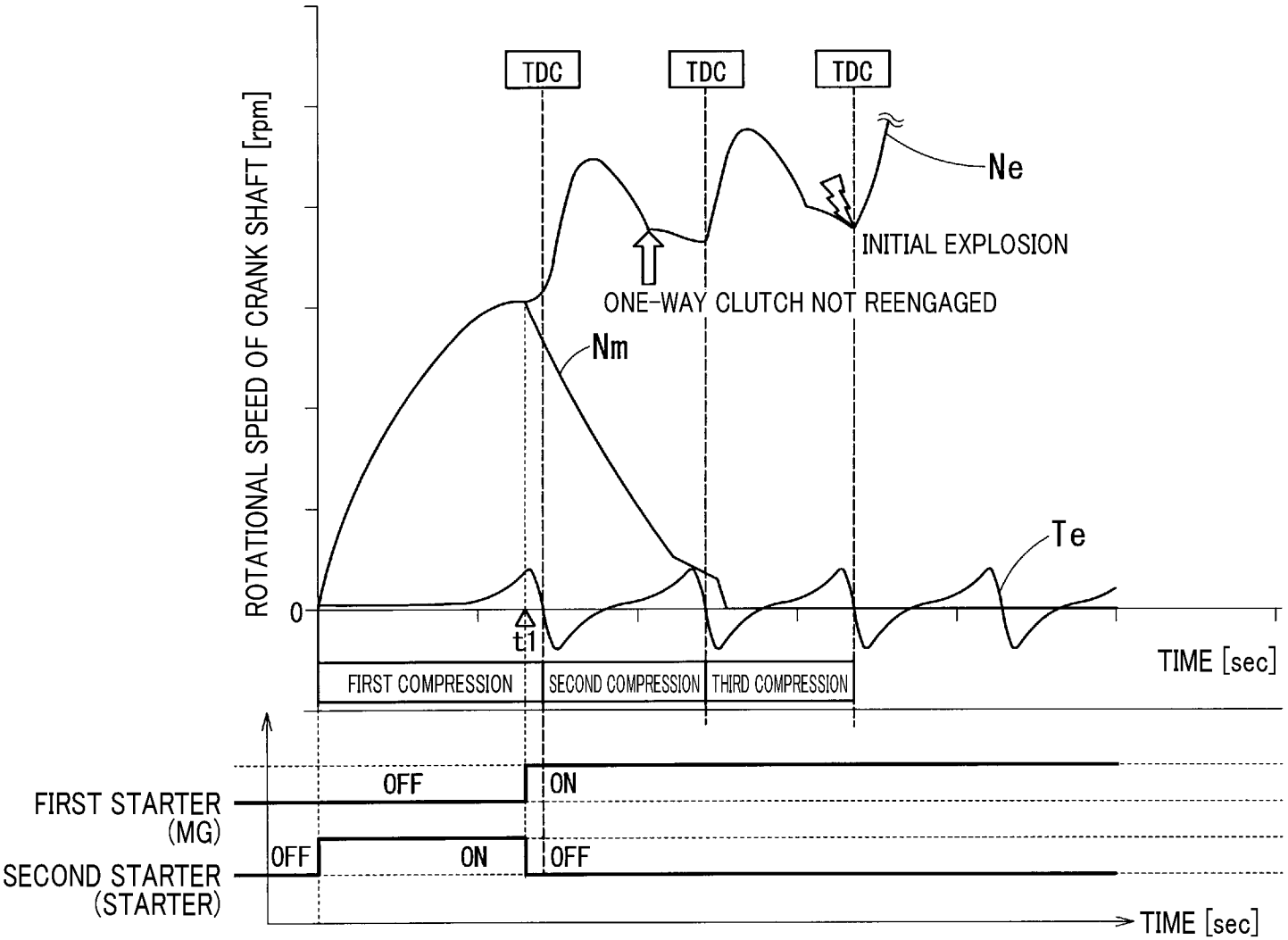
FIG. 4 is a graph illustrating changes in the rotational speed and torque, according to the first embodiment, and a timing diagram illustrating the timing of turning on/off a first starter and a second starter.

As illustrated in FIG. 4, after activating the second starter 7 to start cranking, the engine starting system 1 of the present embodiment performs the following control if the passage conditional expression holds before the engine 2 passes the first TDC. For example, the engine starting system 1 stops the operation of the second starter 7 and starts the motor operation of the first starter 5 at the time (t1) when the passage conditional expression holds. That is, the engine starting system 1 performs cranking by switching from the second starter 7 to the first starter 5. FIG. 4 is a graph showing variations in the engine speed Ne, the motor speed Nm of the second starter 7, and the engine starting torque Te (≈compression torque+friction torque). FIG. 4 also illustrates a timing diagram showing the timing of turning on/off the first starter 5 and the second starter 7. The motor rotational speed Nm is a rotational speed of the crankshaft 3 converted from the gear ratio between the pinion 10 and the ring gear 6.

Thus, the engine starting system 1 of the present embodiment allows the operation of the second starter 7 to be stopped with the timing earlier than in the conventional technique. As a result, the driving time of the second starter 7 (i.e., the time during which the pinion 10 engages with the ring gear 6) decreases, thus reducing the sound of the engagement during cranking.

Other embodiments of the technique of the present disclosure will now be described.

In the following description, components and configurations common to those of the first embodiment are denoted by the same reference numerals as those of the first embodiment, and detailed description thereof will be omitted (the first embodiment will be referred to).

Second Embodiment

Figure 5:
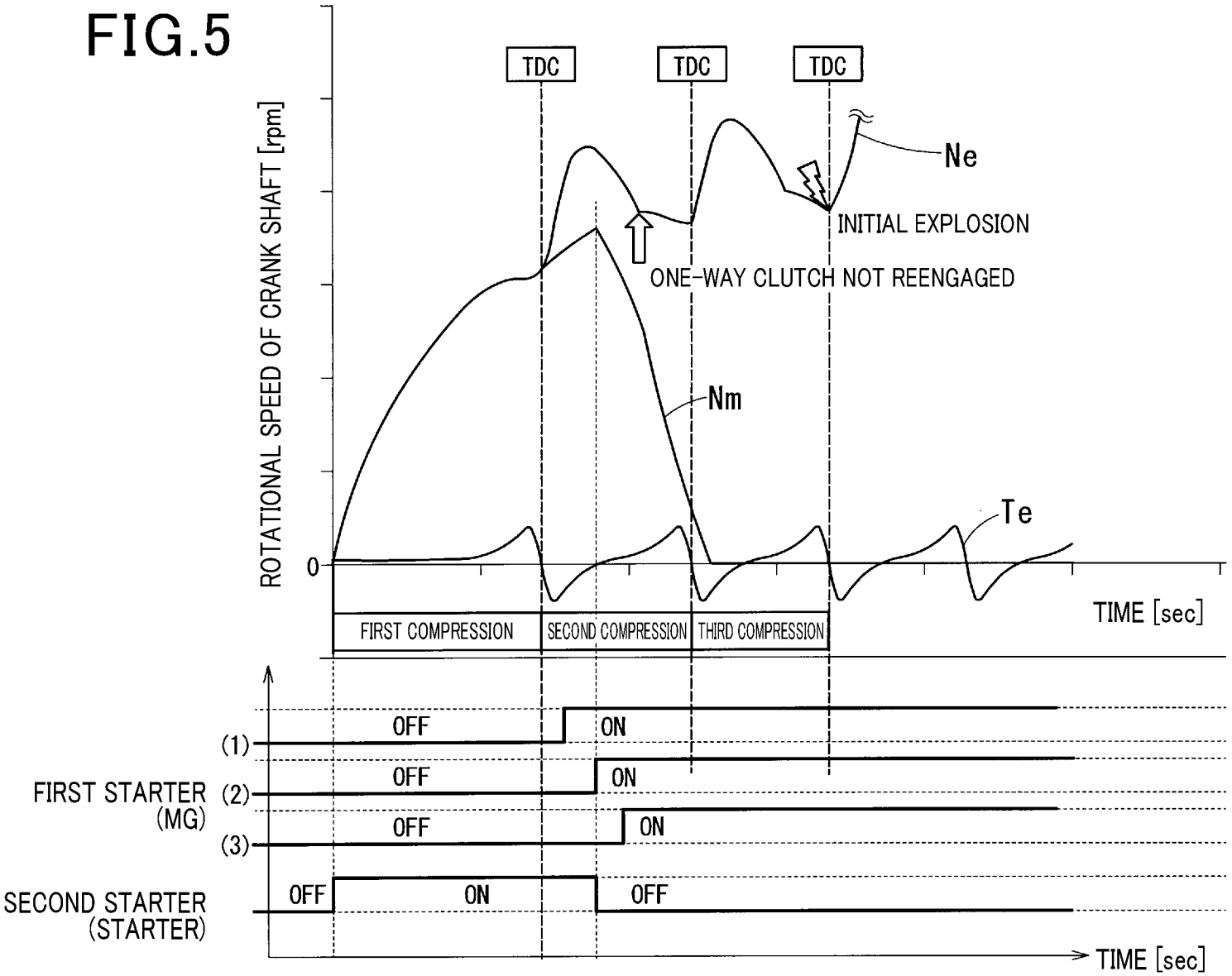
FIG. 5 is a graph illustrating changes in the rotational speed and torque, according to a second embodiment, and a timing diagram illustrating the timing of turning on/off the first and second starters.

The present embodiment is a first example where the engine 2 passes the first TDC without the passage conditional expression being satisfied. Specifically, in the present embodiment, the operation of the second starter 7 is stopped and the motor operation of the first starter 5 is started earlier the clutch engagement timing, as illustrated in FIG. 5. The timing of starting the motor operation of the first starter 5 can be set to any one of three patterns as illustrated in the timing diagram of FIG. 5. Specifically, this timing can be set (1) before the timing of stopping the operation of the second starter 7, or (2) at the timing of stopping the operation of the second starter 7, or (3) after the timing of stopping the operation of the second starter 7. In any of these cases, the motor operation of the first starter 5 is started earlier than the clutch engagement timing.

The clutch engagement timing is the estimated timing with which the clutch 12 would be reengaged if cranking is continued by the second starter 7. In addition, the clutch engagement timing is the timing at which the motor rotational speed of the second starter 7 equals the engine rotational speed after the engine 2 passes the first TDC and the clutch 12 is disengaged. Therefore, the timing can be estimated by monitoring at least the engine speed.

In the present embodiment, even if the engine 2 passes the first TDC without the passage conditional expression being satisfied, the operation of the second starter 7 is stopped earlier than the clutch engagement timing. Thus, in the present embodiment, the clutch 12 will not be reengaged. This results in no gear collision sound being generated by reengagement of the clutch 12. Consequently, the engine starting sound generated during cranking decreases.

In the present embodiment, the motor operation of the first starter 5 is started earlier than the clutch engagement timing. As a result, in the present embodiment, the clutch 12 will not be reengaged even if the timing of stopping the operation of the second starter 7 is slightly delayed. This avoids the generation of a gear collision sound. Furthermore, in the present embodiment, if the motor operation of the first starter 5 is started with the timing (3) mentioned above, it is unnecessary to supply electric power to the first starter 5 and the second starter 7 at the same time. See previous. I won't comment it again after here electric power does not need to be supplied to both the first starter 5 and the second starter 7 at the same time. Thus, in the present embodiment, if the motor operation of the first starter 5 is started with the timing (3), a large amount of instantaneous power is not required when the motor operation of the first starter 5 is started. This prevents the battery 20 from being momentarily interrupted.

Third Embodiment

Figure 6:
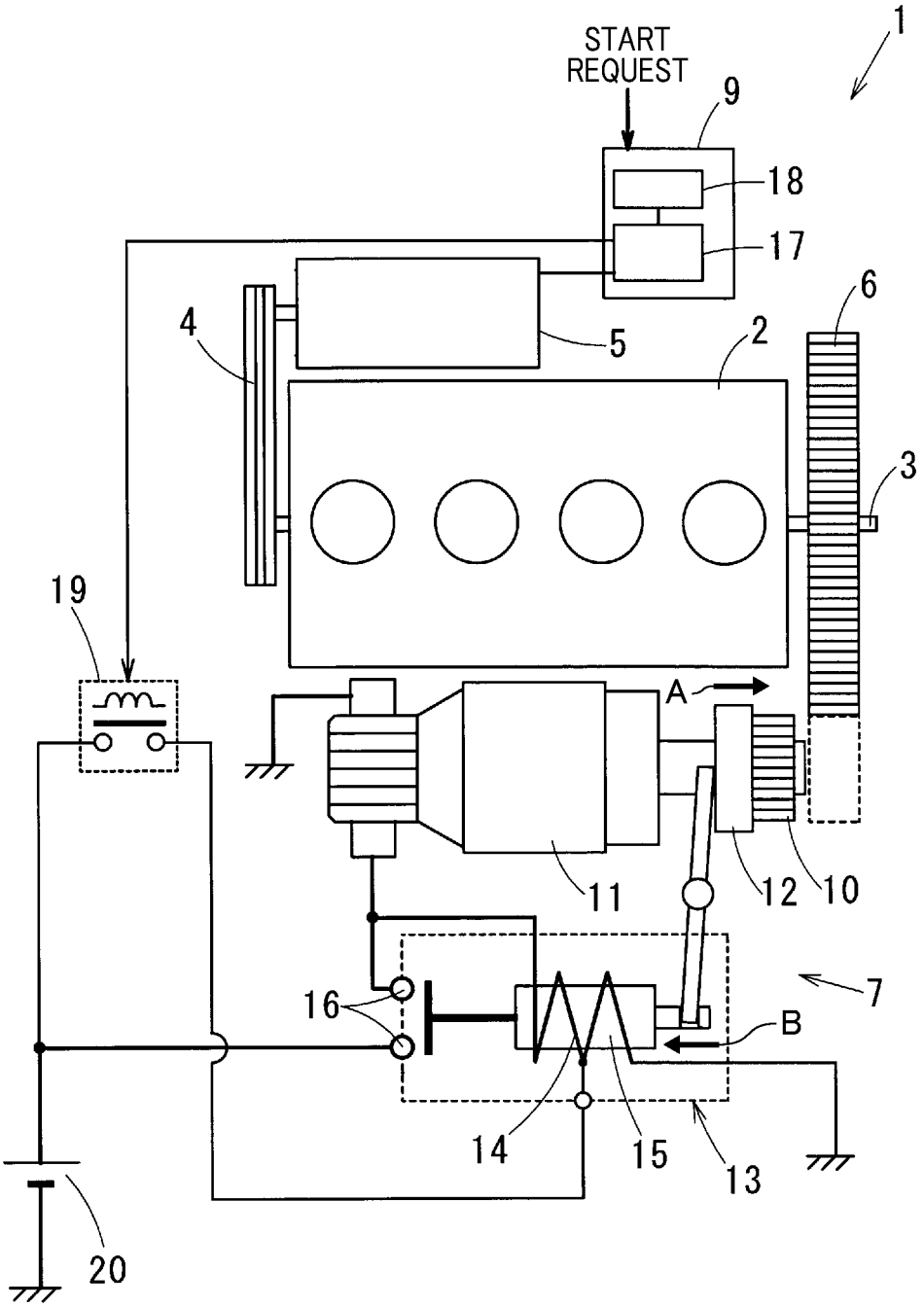
FIG. 6 illustrates the configuration of an engine starting system, according to a third embodiment.

In the present embodiment, as illustrated in FIG. 6, the second controller 9 has a function of the start control section 17 and a function of the passage determination section 18. Note that a control procedure in starting the engine according to the present embodiment is the same as that of the first embodiment, and therefore description of thereof is omitted, referring to the first embodiment (FIG. 2)).

Fourth Embodiment

Figure 7:
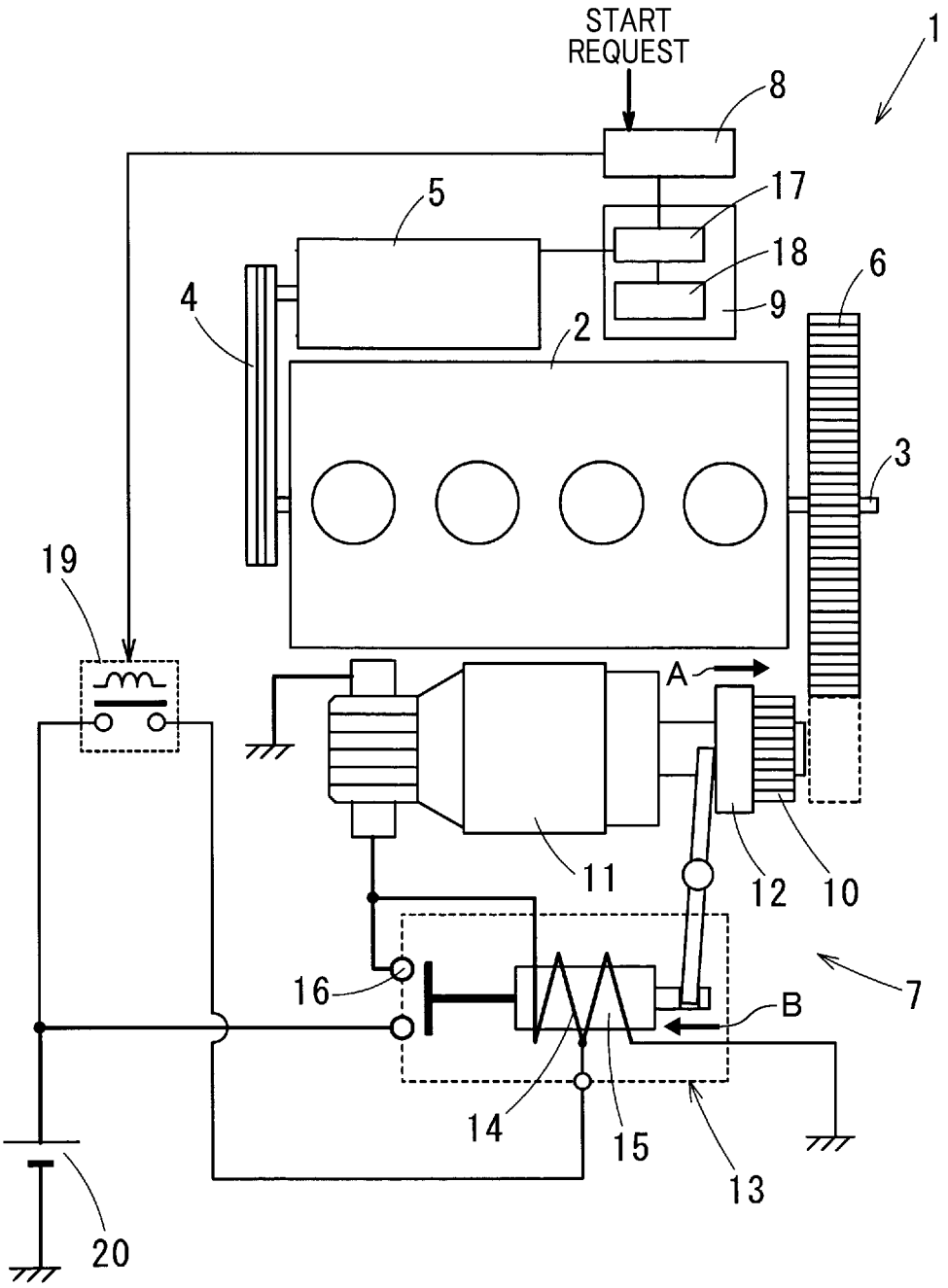
FIG. 7 illustrates the configuration of an engine starting system, according to a fourth embodiment.

In the present embodiment, as illustrated in FIG. 7, the second controller 9 has a function of the start control section 17 and a function of the passage determination section 18. In the present embodiment, a command to the relay 19 (a command to the second starter 7) is issued from the second controller 9 via the first controller 8. Note that a control procedure in starting the engine according to the present embodiment is the same as that of the first embodiment, and therefore description of thereof is omitted, referring to the first embodiment (FIG. 2).

Fifth Embodiment

This embodiment is an example where a tandem solenoid starter is used as the second starter 7.

Figure 8:
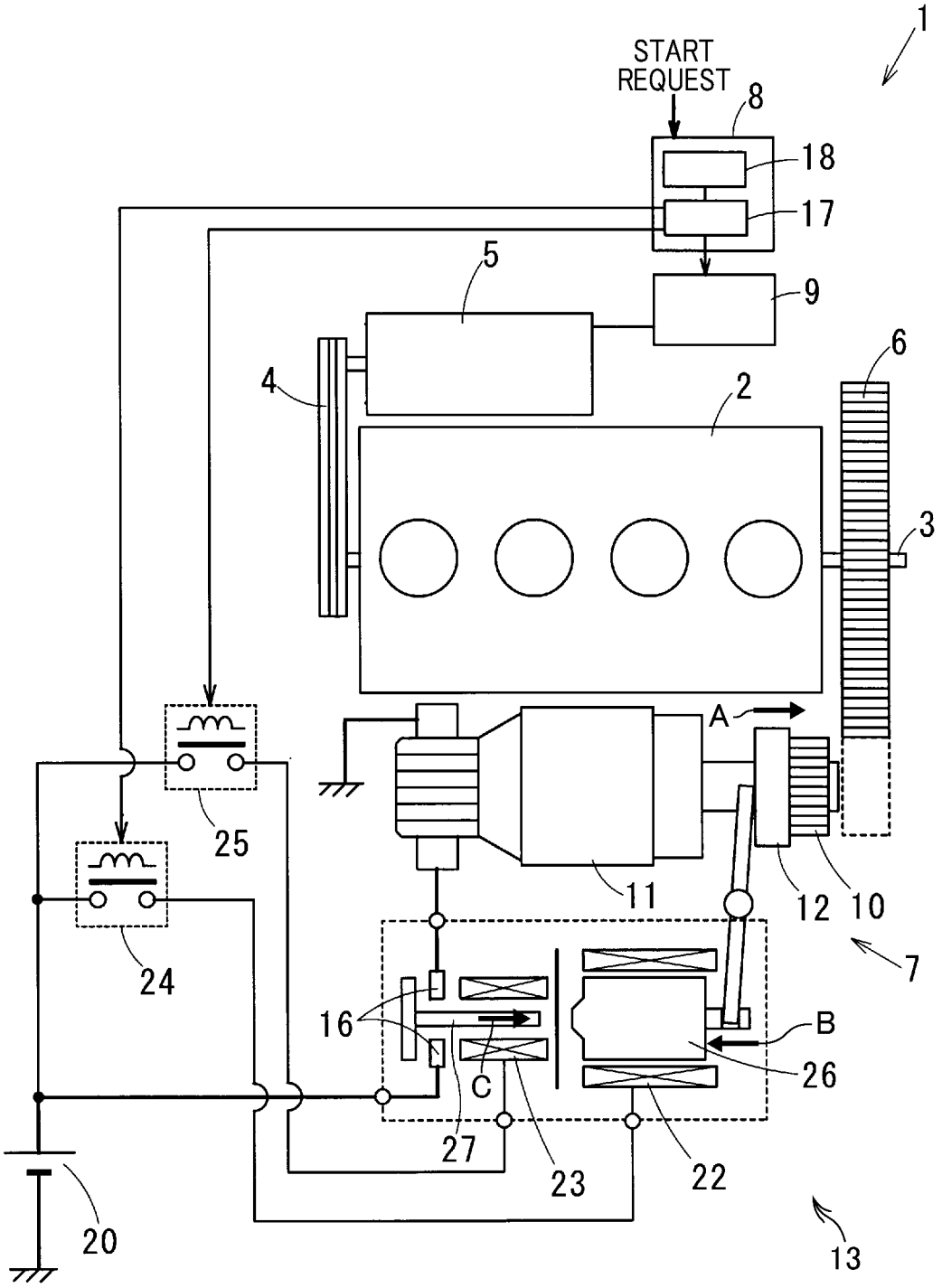
FIG. 8 illustrates the configuration of an engine starting system, according to a fifth embodiment.

As illustrated in FIG. 8, the electromagnetic switch 13 of the second starter 7 includes first and second solenoids 22, 23. The first solenoid 22 pushes out the pinion 10. A second solenoid 23 opens/closes the main contact 16. The operation of the first and second solenoids 22, 23 is independently controlled by the first controller 8.

Figure 9:
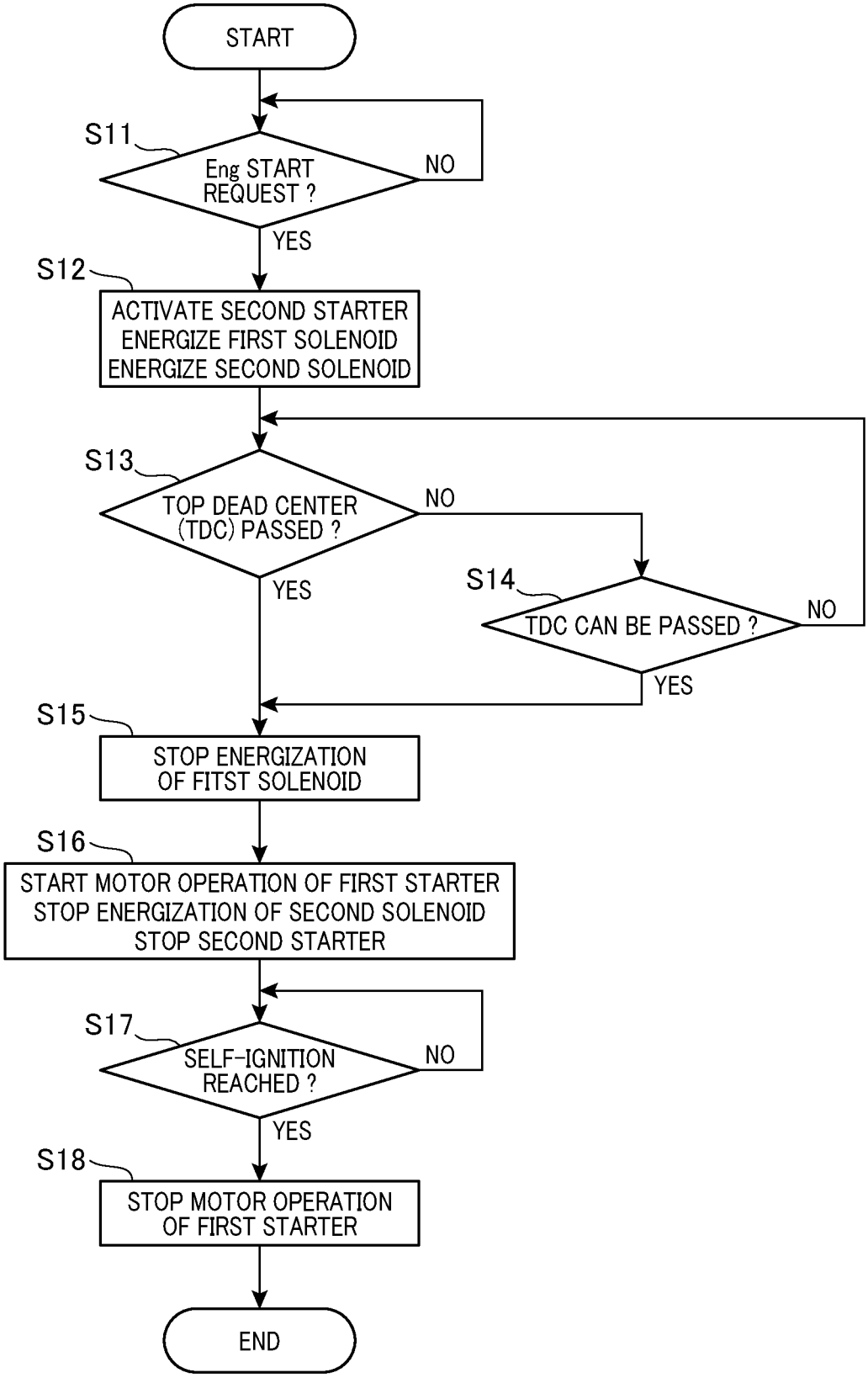
FIG. 9 is a flowchart illustrating a control procedure in starting an engine, according to the fifth embodiment.

A control procedure in starting the engine, executed by the first controller 8 of the present embodiment, will be described below with reference to a flowchart illustrated in FIG. 9. The detailed description of the processes (steps) common to the first embodiment is omitted (refer to FIG. 2 of the first embodiment).

At step S11, the first controller 8 determines whether a request to start the engine 2 has been inputted.

The first controller 8 causes the start control section 17 to perform the following start control on the second starter 7. Specifically, the start control section 17 outputs a turn-on signal to the first and second relays 24, 25 (FIG. 8) to energize the first and second solenoids 22, 23, thereby starting the second starter 7 (step S12). When a first relay 24 is turned on, the first solenoid 22 receives power from the battery 20 to generate an electromagnetic force. In the first solenoid 22, the first plunger 26 is pulled in by the electromagnetic force to move in the direction B (the left direction in FIG. 8). When the second relay 25 is turned on, the second solenoid 23 receives power from the battery 20 to generate an electromagnetic force. In the second solenoid 23, a second plunger 27 is pulled in by the electromagnetic force to move in the direction C (the right direction in FIG. 8). Thus, the pinion 10 is pushed out in the direction A (the right direction in FIG. 8) by the operation of the first solenoid 22 to mesh with the ring gear 6. Then the main contact 16 is closed by the operation of the second solenoid 23, so that electric power is supplied from the battery 20 to the motor 11. As a result, the torque of the motor 11 is transmitted to the pinion 10 via the clutch 12 to rotatably drive the ring gear 6.

At step S13, the first controller 8 determines whether the engine 2 has passed the first TDC (first compression top dead center).

At step S14, the first controller 8 causes the passage determination section 18 to determine whether the passage conditional expression holds.

At step S15, the first controller 8 causes the start controller 17 to output a turn-off signal to the first relay 24 to stop the energization of the first solenoid 22. When the energization of the first solenoid 22 is stopped, the pinion 10 is disengaged from the ring gear 6 in the second starter 7.

The first controller 8 causes the start control section 17 to perform the following control on the first starter 5. Specifically, at step S16, the start control section 17 outputs a drive command to the second controller 9 to start the motor operation of the first starter 5. The first controller 8 also causes the start control section 17 to output a turn-off signal to the second relay 25 to stop the energization of the second solenoid 23. As a result, in the second starter 7, the main contact 16 is opened, so that the power supply from the battery 20 to the motor 11 is stopped. This stops the operation of the second starter 7.

At step S17, the first controller 8 determines whether the engine 2 has reached self ignition.

The first controller 8 causes the start control section 17 to perform the following control on the first starter 5. Specifically, at step S18, the start control section 17 outputs a stop command to the second controller 9 to stop the motor operation of the first starter 5.

In the present embodiment, the following control is performed when the operation of the second starter 7 is stopped. Specifically, before the supply of electric power to the motor 11 is stopped by stopping the supply of electric power to the second solenoid 23, the power supply to the first solenoid 22 is stopped to disengage the pinion 10 from the ring gear 6. As a result, in the present embodiment, the reengagement of the clutch 12 does not substantially occur. Therefore, in the present embodiment, the engine starting sound generated during cranking is reduced even if a time difference occurs between the output of a drive command for starting the motor operation of the first starter 5 to the second controller 9 and the start of the motor operation of the first starter 5.

Sixth Embodiment

The present embodiment is an example where the timing of stopping the operation of the second starter 7 and the timing of starting the motor operation of the first starter 5 are changed according to the initial crank angle. The initial crank angle refers to a crank angle at which cranking is started by the second starter 7 (when the crankshaft 3 is stationary).

The rotational torque obtained with the kinetic energy stored in the engine 2 from the start of cranking increases or decreases by the initial crank angle. Therefore, determining the initial crank angle leads to a decrease in driving torque that can be outputted with the motor operation of the first starter 5. As a result, the first starter 5 consumes less power.

Seventh Embodiment

Figure 10:
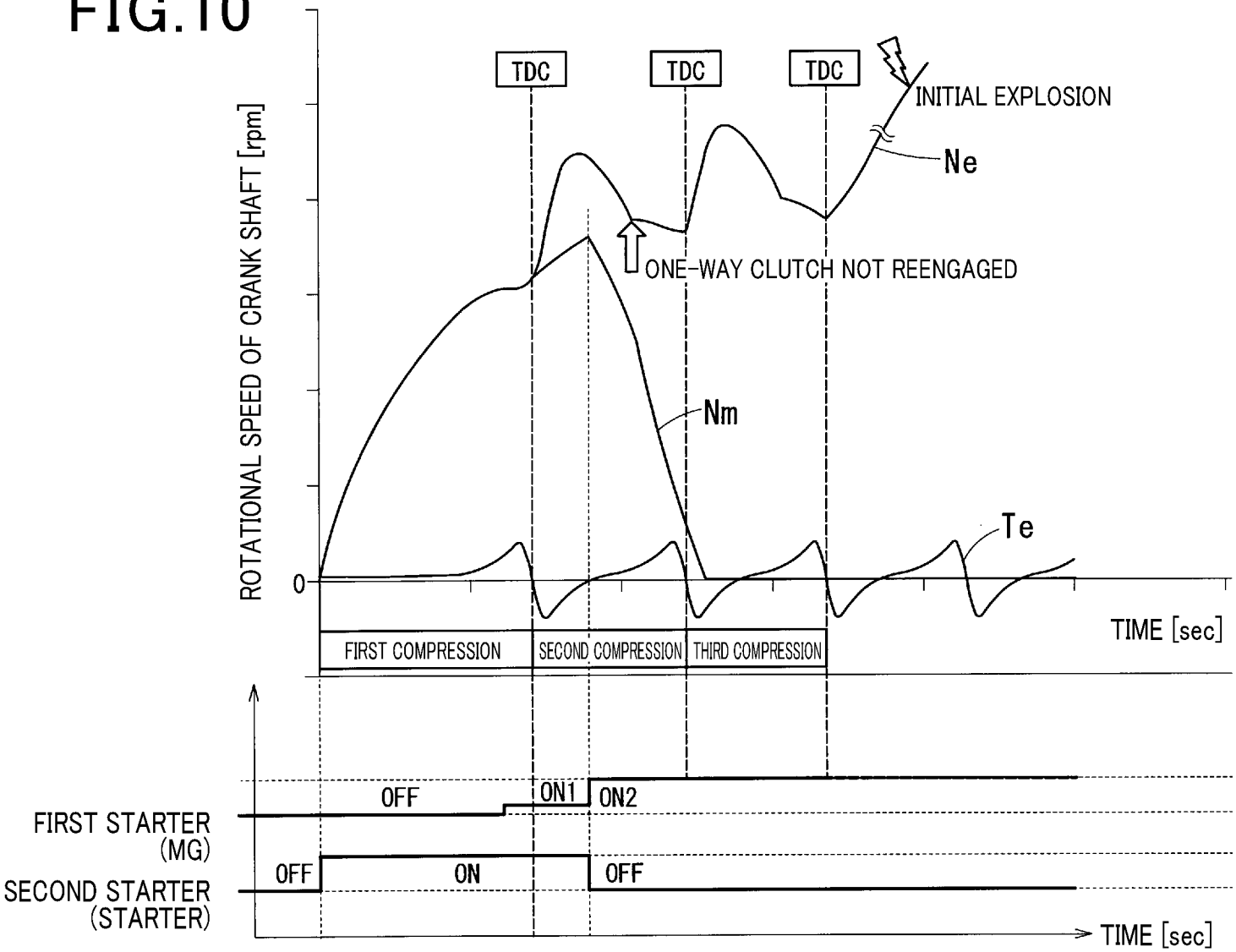
FIG. 10 is a graph illustrating changes in the rotational speed and torque, according to a seventh embodiment, and a timing diagram illustrating the timing of turning on/off the first and second starters.

The present embodiment is a second example where the engine 2 passes the first TDC (first compression top dead center) without the passage conditional expression being satisfied. The present embodiment differs from the second embodiment in the control of the first and second starters 5, 7 by the start control section 17. Specifically, in the present embodiment, the first starter 5 is operated as an electric motor before the engine 2 passes the first TDC as illustrated in FIG. 10. In this case, the first starter 5 outputs a driving torque having a value smaller than the upper limit value that can be set based on the output limit map shown in FIG. 3A, for example. The first starter 5 keeps the driving torque at this smaller value (see the ON1 period shown in FIG. 10).

In the present embodiment, the operation of the second starter 7 is stopped after the engine 2 passes the first TDC and before the clutch engagement timing. Furthermore, in the present embodiment, the driving torque of the first starter 5 is increased in steps to a target value (see the change from ON1 to ON2 shown in FIG. 10).

Thus, in the present embodiment, an operation check for the first starter 5 is performed before the engine 2 passes the first TDC.

The above-described timing for increasing the driving torque of the first starter 5 may be before or after the operation of the second starter 7 is stopped. In addition, the timing of increasing the driving torque of the first starter 5 and the timing of stopping the operation of the second starter 7 may be changed according to the initial crank angle.

Eighth Embodiment

Figure 11:
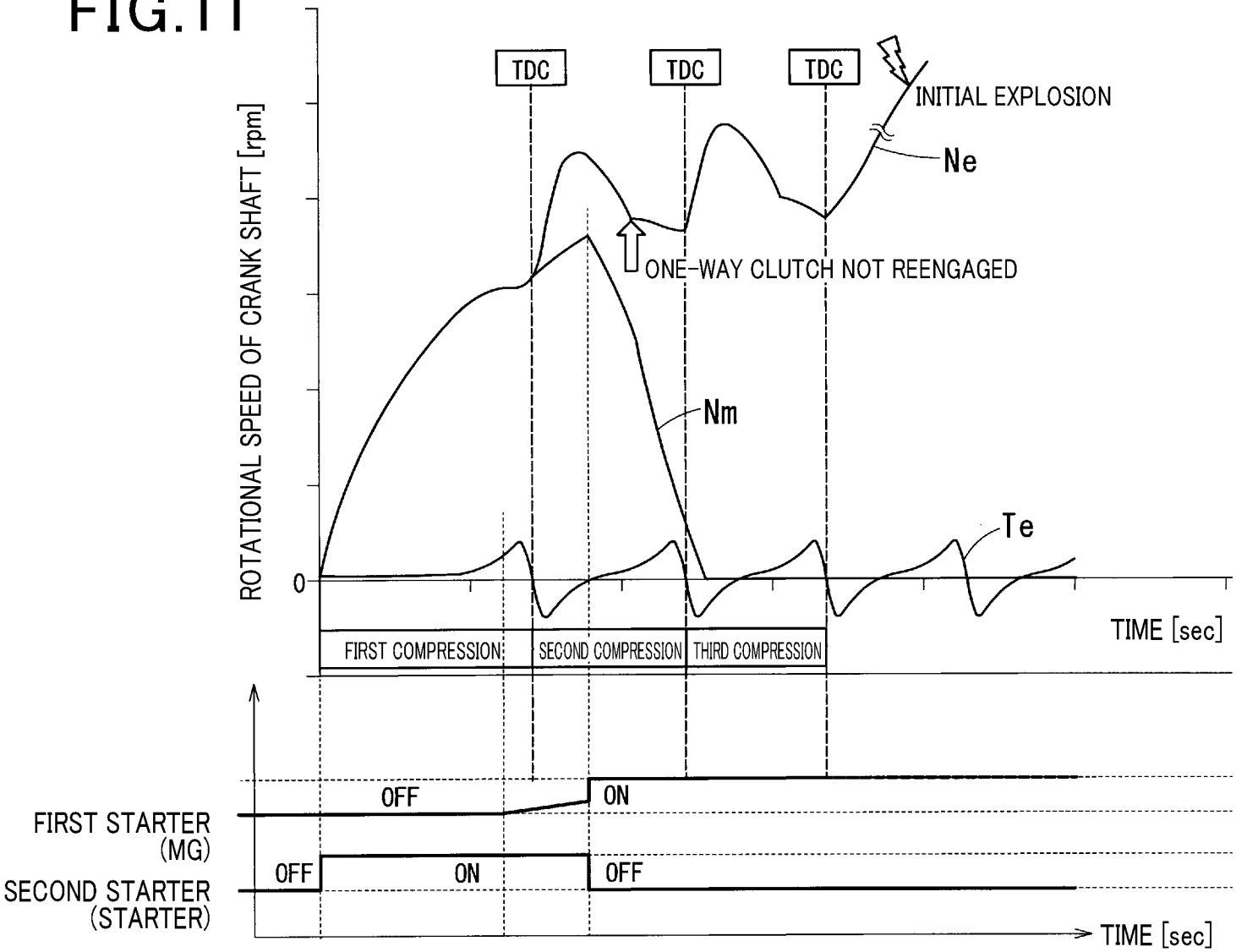
FIG. 11 is a graph illustrating changes in the rotational speed and torque, according to a seventh embodiment, and a timing diagram illustrating the timing of turning on/off the first and second starters.

The present embodiment is a third example where the engine 2 passes the first TDC without the passage conditional expression being satisfied. The present embodiment differs from the seventh embodiment in the control of the first and second starters 5, 7 by the start control section 17. More specifically, in the present embodiment, the first starter 5 is operated as an electric motor before the engine 2 passes the first TDC. In the present embodiment, unlike the seventh embodiment, the driving torque is linearly increased (the driving torque is increased in proportion to time) after the operation of the first starter 5 is started as illustrated in FIG. 11. In the present embodiment, the operation of the second starter 7 is stopped before the clutch engagement timing after the engine 2 passes the first TDC. Furthermore, in the present embodiment, the driving torque of the first starter 5 is increased in steps to a target value.

The above-described timing for increasing the driving torque of the first starter 5 may be set before or after the operation of the second starter 7 is stopped. In addition, the timing of increasing the driving torque of the first starter 5 and the timing of stopping the operation of the second starter 7 may be changed according to the initial crank angle.

Ninth Embodiment

Figure 12:
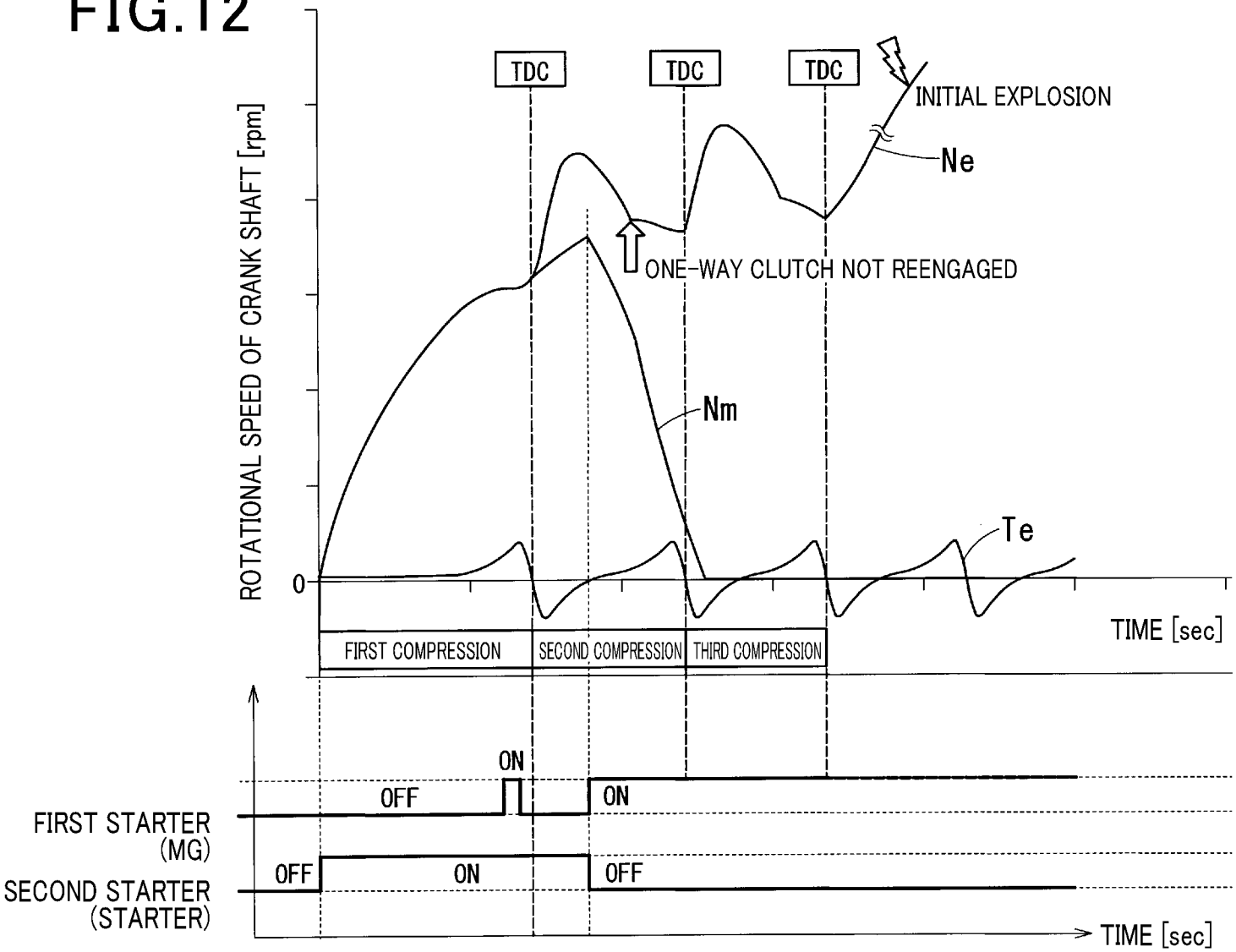
FIG. 12 is a graph illustrating changes in the rotational speed and torque, according to a seventh embodiment, and a timing diagram illustrating the timing of turning on/off the first and second starters.

This embodiment is a fourth example where the engine 2 passes the first TDC without the passage conditional expression being satisfied. The present embodiment differs from the seventh and eighth embodiments in the control of the first and second starters 5 and 7 by the start control section 17. More specifically, in the present embodiment, the first starter 5 is operated as an electric motor before the engine 2 passes the first TDC. In the present embodiment, unlike the seventh and eighth embodiments, the first starter 5 is temporarily operated and stopped as an electric motor as illustrated in FIG. 12. In the present embodiment, the operation of the second starter 7 is stopped after the engine 2 passes the first TDC and before the clutch engagement timing. In the present embodiment, the first starter 5 is operated as an electric motor.

Thus, in the present embodiment, an operation check for the engine starting system 1 can be performed before the engine 2 passes the first TDC.

[Modification]

In the first embodiment, known values are inputted to the first controller 8 of the engine starting system 1 as the compression torque and the friction torque of the engine 2, but this is not limiting. For example, the battery voltage or the battery current can be monitored to calculate a peak value of the compression torque. In the compression stroke, the compression torque is much greater than the friction torque (compression torque>>friction torque). Therefore, in the engine starting torque during the compression stroke, the ratio of the compression torque is large. This compression torque peaks slightly before TDC (compression top dead center). At the peak position of the compression torque, the slopes of the battery voltage and the battery current are substantially zero. Therefore, the peak value of the compression torque can be calculated by determining the correlation between the value of the battery voltage or the battery current at an inclination of nearly zero degrees and the compression torque.

The engine starting system 1 determines the in-cylinder pressure of the engine 2 using an existing in-cylinder pressure sensor. Then the first controller 8 can calculate the compression torque by theoretical calculation based on the detection result.

In the first embodiment, the engine starting system 1 determines the rotation angle (crank angle) of the crankshaft 3 using the crank angle sensor, but this is not limiting. For example, the first starter 5 is connected to the crankshaft 3 via a belt 4. The engine starting system 1 determines the rotation angle of the first starter 5 using the rotation angle sensor provided in the first starter 5. Then the crank angle is estimated based on the rotation angle. In this case, the engine starting system 1 can determine the timing at which the first TDC (first compression top dead center) is passed without the crank angle sensor. As a result, the engine starting system 1 does not need an additional sensor, branching of sensor wirings, and the like. This simplifies the system and reduces cost.

The first starter 5 of the first embodiment is connected to the crankshaft 3 via the belt 4, but this is not limiting. For example, a clutch may be built in pulleys of the first starter 5 over which the belt 4 is looped.

In the first embodiment, the passage conditional expression includes drive torque that can be outputted by the first starter 5, but this is not limiting. The passage conditional expression may not include drive torque that can be outputted by the first starter 5. For example, the passage determination section 18 included in the first controller 8 may determine whether the operation of the second starter 7 can be stopped before the engine 2 passes the first TDC (first compression top dead center) based on the magnitude relationship between the rotational torque obtained with the kinetic energy stored in the engine 2 from the start of cranking and the engine starting torque (compression torque+friction torque of the engine 2). In this case, if the passage conditional expression holds before the engine 2 passes the first TDC (first compression top dead center), the timing of stopping the operation of the second starter 7 does not need to coincide with the timing of starting the motor operation of the first starter 5. That is, the timing of staring the motor operation of the first starter 5 does not necessarily have to be before TDC (compression top dead center). This timing only needs to be before the clutch engagement timing at the latest.

REFERENCE SIGNS LIST

1 . . . Engine starting system
2 . . . Engine
3 . . . Crankshaft
4 . . . Belt
5 . . . First starter
6 . . . Ring gear
7 . . . Second starter
8 . . . First controller
9 . . . Second controller (start signal receiver)
10 . . . Pinion
11 . . . Motor
12 . . . Clutch (one-way clutch)
13 . . . Electromagnetic switch (solenoid device)
17 . . . Start controller
18 . . . Passage determination section
19 . . . Relay (stop signal receiver)

The invention claimed is:

1. An engine starting system comprising:

a first starter that is connected to a crankshaft of an engine and rotatably drives the crankshaft;

a second starter that cranks the engine by rotatably driving a ring gear connected to the crankshaft; and a controller that controls operation of the first starter and the second starter, wherein the first starter is a motor generator having a function of an electric generator and a function of an electric motor, the second starter is a pinion enmeshing starter configured to include a motor that receives electric power to cause it to rotate, a pinion that moves axially to mesh with the ring gear, a one-way clutch that transmits torque in only one direction from the motor to the pinion and blocks torque transmission from the pinion to the motor, and a solenoid device having a function of moving the pinion axially and a function of starting/stopping power supply to the motor, a magnitude relationship such that required passage torque is greater than engine starting torque is defined as a passage conditional expression, where the required passage torque is obtained by adding rotational torque obtained with kinetic energy stored in the engine from the start of cranking and driving torque which can be outputted with motor operation of the first starter, and the engine starting torque is obtained by adding compression torque and friction torque of the engine, the controller includes a start control section that, after activating the second starter to start cranking in response to a request for starting the engine, stops operation of the second starter and starts motor operation of the first starter at a predetermined timing, and a passage determination section that determines whether the passage conditional expression holds after cranking is started by the second starter, and the start control section stops operation of the second starter and starts motor operation of the first starter if the passage conditional expression holds before the engine passes a first compression top dead center, regardless of whether the engine has passed the first compression top dead center.

2. The engine starting system according to claim 1, wherein if the engine crosses the first compression top dead center without the passage conditional expression being satisfied, the start control section sets a timing of a stopping operation of the second starter and a timing of a starting motor operation of the first starter to be before an estimated timing at which the one-way clutch is reengaged.

3. The engine starting system according to claim 2, wherein the start control section sets the timing of the starting motor operation of the first starter to be the same as the timing of the stopping operation of the second starter, or before or after the timing of the stopping operation of the second starter.

4. The engine starting system according to claim 1, wherein the start control section sets a timing of a starting motor operation of the first starter to be after the power supply to the motor of the second starter is stopped.

5. The engine starting system according to claim 1, wherein the start control section determines an initial crank angle before the cranking is started, and changes a timing of a stopping operation of the second starter and a timing of a starting motor operation of the first starter according to the initial crank angle, after the cranking is started.

6. The engine starting system according to claim 1, wherein the controller temporarily operates the first starter as an electric motor and stops the first starter before the engine passes the first compression top dead center.

7. An engine starting system comprising:

a first starter that is connected to a crankshaft of an engine and rotatably drives the crankshaft, a second starter that cranks the engine by rotatably driving a ring gear connected to the crankshaft, and a controller that controls operation of the first starter and the second starter, wherein the first starter is a motor generator having a function of an electric generator and a function of an electric motor, the second starter is a pinion enmeshing starter including a motor that receives electric power to cause it to rotate, a pinion that moves axially to mesh with the ring gear, a one-way clutch that transmits torque in only one direction from the motor to the pinion and blocks torque transmission from the pinion to the motor, and a solenoid device having a function of moving the pinion axially and a function of starting/stopping power supply to the motor, a magnitude relationship such that required passage torque is greater than engine starting torque is defined as a passage conditional expression, where the required passage torque is obtained by adding rotational torque obtained with kinetic energy stored in the engine from the start of cranking and driving torque which can be outputted with motor operation of the first starter, and the engine starting torque is obtained by adding compression torque and friction torque of the engine, the controller includes a start control section that, after activating the second starter to start cranking in response to a request for starting the engine, starts operation of the first starter and stops motor operation of the second starter at a predetermined timing, and a passage determination unit that determines whether the passage conditional expression holds after cranking is started by the second starter, the start control unit stops operation of the second starter and increases an output due to motor operation of the first starter if the passage conditional expression holds before the engine passes a first compression top dead center, regardless of whether the engine has passed the first compression top dead center.

8. The engine starting system according to claim 7, wherein the start control section sets a timing of a stopping operation of the second starter and a timing of increasing an output due to motor operation of the first starter to be before an estimated timing at which the one-way clutch is reengaged, if the engine passes the first compression top dead center without the passage conditional expression being satisfied.

9. The engine starting system according to claim 8, wherein the start control section sets the timing of increasing an output due to motor operation of the first starter to be the same as the timing of the stopping operation of the second starter or to be before or after the timing of the stopping operation of the second starter.

10. The engine starting system according to claim 7, wherein the start control section sets a timing of increasing an output due to motor operation of the first starter to be after power supply to the motor of the second starter is stopped.

11. The engine starting system according to claim 7, wherein the start control section determines an initial crank angle before the cranking is started, and changes a timing of a stopping operation of the second starter and a timing of increasing an output due to motor operation of the first starter according to the initial crank angle, after the cranking is started.

12. The engine starting system according to claim 1, wherein the solenoid device includes a first solenoid having a function of axially moving the pinion, and a second solenoid having a function of starting/stopping energization current to the motor, and the start control section, when a stopping operation of the second starter, causes the first solenoid to disengage the pinion from the ring gear before the second solenoid stops the power supply to the motor.

13. The engine starting system according to claim 1, wherein if a passage determination condition is the at least one condition necessary for determining whether the passage conditional expression holds, the passage determination section sets an engine speed as the passage conditional condition.

14. The engine starting system according to claim 13, wherein the start control section calculates the engine speed based on a rotation angle of the crank shaft determined by the crank angle sensor.

15. The engine starting system according to claim 13, including a rotation angle sensor that determines a rotation angle of the first starter, wherein the start control section estimates a crank angle based on a rotation angle of the first starter determined by the rotation angle sensor and calculates the engine speed based on the estimated crank angle.

16. The engine starting system according to claim 1, wherein the first starter is connected to the crank shaft via a belt.

17. A first starter comprising a motor generator connected to a crank shaft of an engine and having a function of an electric motor that rotatably drives the crankshaft and a function of an electric generator, and operation of the first starter being controlled by a controller together with a second starter which is a pinion enmeshing starter that cranks the engine by rotatably driving a ring gear connected to the crankshaft, wherein a magnitude relationship such that required passage torque is greater than engine starting torque is defined as a passage conditional expression, where the required passage torque is obtained by adding rotational torque obtained with kinetic energy stored in the engine from the start of cranking and driving torque which can be outputted with motor operation of the electric motor, and the engine starting torque is obtained by adding compression torque and friction torque of the engine, the controller includes a start control section that, after activating the second starter to start cranking in response to a request for starting the engine, stops operation of the second starter and starts motor operation of the first starter at a predetermined timing, and a passage determination section that determines whether the passage conditional expression is satisfied after cranking is started by the second starter, the start control section stops operation of the second starter and transmits a start signal for a starting motor operation of the first starter if the passage conditional expression holds before the engine passes a first compression top dead center, regardless of whether the engine has passed the first compression top dead center, and the first starter has a start signal receiver that receives the start signal.

18. A second starter, operation of the second starter being controlled by a controller together with a first starter that is connected to a crank shaft of an engine and the second starter comprising a motor generator having a function of an electric motor that rotatably drives the crank shaft and a function of an electric generator, and the second starter being a pinion enmeshing starter that cranks the engine by rotatably driving a ring gear connected to the crankshaft, wherein a magnitude relationship such that required passage torque is greater than engine starting torque is defined as a passage conditional expression, where the required passage torque is obtained by adding rotational torque obtained with kinetic energy stored in the engine from the start of cranking and driving torque which can be outputted with motor operation of the first starter, and the engine starting torque is obtained by adding compression torque and friction torque of the engine, the controller includes a start control section that, after activating the second starter to start cranking in response to a request for starting the engine, stops operation of the second starter and starts motor operation of the first starter at a predetermined timing, and a passage determination section that determines whether the passage conditional expression holds after cranking is started by the second starter, the start control section stops motor operation of the first starter and transmits a stop signal for stopping operation of the second starter if the passage conditional expression holds before the engine passes a first compression top dead center, regardless of whether the engine has passed the first compression top dead center, and the second starter has a stop signal receive that receives the stop signal.

19. A first starter comprising a motor generator connected to a crank shaft of an engine and having a function of an electric motor that rotatably drives the crankshaft and a function of an electric generator, and operation of the first starter being controlled by a controller together with a second starter which is a pinion enmeshing starter that cranks the engine by rotatably driving a ring gear connected to the crankshaft, wherein a magnitude relationship such that required passage torque is greater than engine starting torque is defined as a passage conditional expression, where the required passage torque is obtained by adding rotational torque obtained with kinetic energy stored in the engine from the start of cranking and driving torque which can be outputted with motor operation of the electric motor, and the engine starting torque is obtained by adding compression torque and friction torque of the engine, the controller includes a start control section that, after activating the second starter to start cranking in response to a request for starting the engine, starts motor operation of the first starter and stops operation of the second starter at a predetermined timing, and a passage determination section that determines whether the passage conditional expression holds after cranking is started by the second starter, the start control section stops operation of the second starter and transmits a start signal for increasing an output due to motor operation of the first starter if the passage conditional expression holds before the engine passes a first compression top dead center, regardless of whether the engine has passed the first compression top dead center, and the first starter has a start signal receiver that receives the start signal.

20. A second starter, operation of the second starter being controlled by a controller together with a first starter that is connected to a crank shaft of an engine and the second starter comprising a motor generator having a function of an electric motor that rotatably drives the crank shaft and a function of an electric generator, and the second starter being a pinion enmeshing starter that cranks the engine by rotatably driving a ring gear connected to the crankshaft, wherein a magnitude relationship such that required passage torque is greater than engine starting torque is defined as a passage conditional expression, where the required passage torque is obtained by adding rotational torque obtained with kinetic energy stored in the engine from the start of cranking and driving torque which can be outputted with motor operation of the first starter, and the engine starting torque is obtained by adding compression torque and friction torque of the engine, the controller includes a start control section that, after activating the second starter to start cranking in response to a request for starting the engine, starts motor operation of the first starter and stops operation of the second starter at a predetermined timing, and a passage determination unit that determines whether the passage conditional expression holds after cranking is started by the second starter, the start control section increases an output due to motor operation of the first starter and transmits a stop signal for stopping operation of the second starter if the passage conditional expression holds before the engine passes a first compression top dead center, regardless of whether the engine has passed the first compression top dead center, and the second starter has a stop signal receive that receives the stop signal.

* * * * *